US006401427B1

(12) United States Patent
Snyder

(10) Patent No.: US 6,401,427 B1
(45) Date of Patent: Jun. 11, 2002

(54) MODULAR SHIELD

(75) Inventor: Keith W. Snyder, Sandia Park, NM (US)

(73) Assignee: Sandia Corporation, Albuquerque, NM (US)

( * ) Notice: Subject to any disclaimer, the term of this patent is extended or adjusted under 35 U.S.C. 154(b) by 0 days.

(21) Appl. No.: 09/527,523

(22) Filed: Mar. 16, 2000

(51) Int. Cl.[7] ..... E04B 1/61

(52) U.S. Cl. ..... 52/764; 52/780; 109/49.5

(58) Field of Search ..... 52/36.1, 238.1, 52/239, 241, 264, 270, 282.1, 282.2, 481.1, 481.2, 762, 764, 775, 780, 781, 656.1; 109/15, 49.5, 78–80, 85

(56) References Cited

U.S. PATENT DOCUMENTS

| | | | | | |
|---|---|---|---|---|---|
| 3,423,893 | A | * | 1/1969 | Hyatt | 52/241 |
| 3,974,608 | A | * | 8/1976 | Grearson | 52/235 |
| 4,784,552 | A | | 11/1988 | Rebentisch | 411/85 |
| 5,307,600 | A | | 5/1994 | Simon, Jr. et al. | 52/241 |
| 5,887,391 | A | * | 3/1999 | Shoup | 52/202 |
| 5,950,380 | A | * | 9/1999 | Pearson | 52/204.5 |

OTHER PUBLICATIONS

Unistrut® Product Application Guide IND 700, 12/98, downloaded from www.unistrut.com Feb. 2000.

Strereon Limited, web page dowloaded from www.conservatoryonline.com/working2.htm, Feb. 2000.

Lexgard® HP875 Laminate, 3/98, downloaded from www.ge.com,Feb. 2000.

Horizon Privacy Walls and Security Walls, downloaded from www.unitstrut, com, Feb. 2000.

W. A. Keenan & G. E. Meyers, Suspended Polycarbonate Shield to Defeat Terrorist Threats.

W. H. Ciolek, "Laboratory Shielding for Projectiles", Jul. 14, 1966.

Shope and Kennan, "Safety Window Shield to Protect Against External explosions", 7/91, pp 1–38.

* cited by examiner

*Primary Examiner*—Carl D. Friedman
*Assistant Examiner*—L. Bennett Porterie, Jr.
(74) *Attorney, Agent, or Firm*—Gregory H Libman

(57) ABSTRACT

A modular system for containing projectiles has a sheet of material including at least a polycarbonate layer held by a metal frame having a straight frame member corresponding to each straight edge of the sheet. Each frame member has a U-shaped shield channel covering and holding a straight edge of the sheet and an adjacent U-shaped clamp channel rigidly held against the shield channel. A flexible gasket separates each sheet edge from its respective shield channel; and each frame member is fastened to each adjacent frame member only by clamps extending between adjacent clamp channels.

12 Claims, 4 Drawing Sheets

MODULAR SHIELD

The United States Government has rights in this invention pursuant to Department of Energy Contract No. DE-AC04-94AL85000 with Sandia Corporation.

CROSS REFERENCE TO RELATED APPLICATIONS (Not Applicable)

BACKGROUND OF THE INVENTION

Any type of rotating machinery subjects operating personnel to danger from flying projectiles. High speed centrifuges are particularly dangerous since their purpose is to spin test objects, usually at the end of a rotating arm. If something should fail, either the test object or part of the rotating arm can leave the centrifuge tangentially with a high kinetic energy.

For safety purposes, most centrifuges are designed with some sort of primary containment or enclosure surrounding the rotating components of the machine to contain any form of fragment that might be released from the machine. However, there are always occasions when the primary containment is opened, such as for loading test parts, temperature conditioning, or machine maintenance. If these entry points are not closed and interlocked properly, or if the interlocks are purposely bypassed, or if the machine would fail in a mode not completely understood by the designers, a catastrophic failure of the primary containment can occur, causing part fragments to be thrown from the machine with a high kinetic energy.

In addition, other types of rotating machinery also have the capability of ejecting projectiles with high kinetic energy.

Any failure mode of a rotating machine can cause damage to equipment in the vicinity and also personnel injury or death. These failure modes are common to all centrifuges and any high speed rotating machinery. Because of a history of machine failures and uncertain methods in determining failure criteria, it is considered a good safety practice to surround all rotating machinery, not only with primary containment, but with a secondary method of containment to protect operating personnel. The secondary containment should be designed to contain any fragments that could breach the primary containment.

Typical barrier designs which could be utilized for secondary containment of a centrifuge include steel plate/frame structures, reinforced concrete walls, concrete block walls, and a concrete walled excavated pit with either a steel or concrete roof. These classical machine barrier designs can be quite expensive to fabricate and install. An idea for a innovative and economical approach to machine containment was needed.

Polycarbonate sheets (such as Lexan®) have long been used as transparent barriers. For example, the Oklahoma County Detention Center uses Lexan sheets bolted to a Unistrute® frame (Unistrut Corp., Wayne, Mich.) to enclose a mezzanine within the institution. Of course, this application does not anticipate the containment of a centrifuge or similar equipment, nor is it modular and easily assembled and moved.

There has been limited testing of polycarbonate used in a shielding application. Most of the data available is for the ballistic regime at velocities of 1000–3000 ft/s. Most of the research performed on characterizing polycarbonate began in the 1960's and was classified and therefore not included in this report. The U.S. Air Force performed a minor amount of ballistic testing to determine the material's applicability to transparent armor. The research also included early bonding agents to bond polycarbonate with glass. One of the most significant conclusions from this early work was the determination that the ballistic performance of polycarbonate is not related to its low-rate impact properties. This fact is significant in that there has not been a great amount of testing performed on low-rate impacts. The U.S. Army Ballistic Research Laboratory investigated the impact resistance of various glazing materials including polycarbonate for improving safety in railroad vehicles. Limited low impact testing was performed with 0.22 caliber ballistic testing. Proof testing of polycarbonate shields for laboratory protection was stressed by W. H. Ciolek, "Laboratory Shielding for Projectiles," *Proceedings of the American Institute of Chemical Engineers*, National Meeting 1986, AIChE, New York, Pap 143c, who performed some limited impact testing on the material. The targets impacted were all 12 inch square without much detail given on support methods. The U.S. Naval Civil Engineering Laboratory was concerned with protecting building occupants from an external terrorist threat, such as an explosive blast, and developed a cable suspended polycarbonate window shield to absorb blast energy and shield against fragments from such explosions. More recently, workers in Germany have been investigating the use of polycarbonate for shielding personnel from machine tools. They have reported testing with small masses, (0.22–11) lb, striking a clamped 19.5 inch square target.

A successful containment shield should accomplish two goals: most importantly, it must stop the energetic fragment. In addition, it should stop the fragment with minimal movement of the shield. There will be significant transfer of energy from the fragment to the shield; if that energy moves the shield too far, then that movement could also cause damage to the surroundings the shield is intended to protect.

SUMMARY OF THE INVENTION

It is an object of this invention to provide an inexpensive modular shield that can withstand the impact from a piece thrown from a centrifuge.

It is another object of this invention to provide a shield formed of a standard sheet of polycarbonate held in place by conventional metal U-channel.

To achieve the foregoing and other objects, and in accordance with the purpose of the present invention, as embodied and broadly described herein, the present invention may comprise a modular system for containing projectiles including a sheet of polycarbonate material held by a metal frame having a straight frame member corresponding to each straight edge of the sheet. Each frame member comprises a U-shaped shield channel covering and holding a straight edge of the sheet and an adjacent U-shaped clamp channel rigidly held against the shield channel. A flexible gasket separates each sheet edge from its respective shield channel; and each frame member is fastened to each adjacent frame member only by clamping means extending between adjacent clamp channels.

Additional objects, advantages, and novel features of the invention will become apparent to those skilled in the art upon examination of the following description or may be learned by practice of the invention. The objects and advantages of the invention may be realized and attained as particularly pointed out in the appended claims.

BRIEF DESCRIPTION OF THE DRAWINGS

The accompanying drawings, which are incorporated in and form part of the specification, illustrate an embodiment of the present invention and, together with the description, serve to explain the principles of the invention.

DETAILED DESCRIPTION OF THE INVENTION

Figure 1:
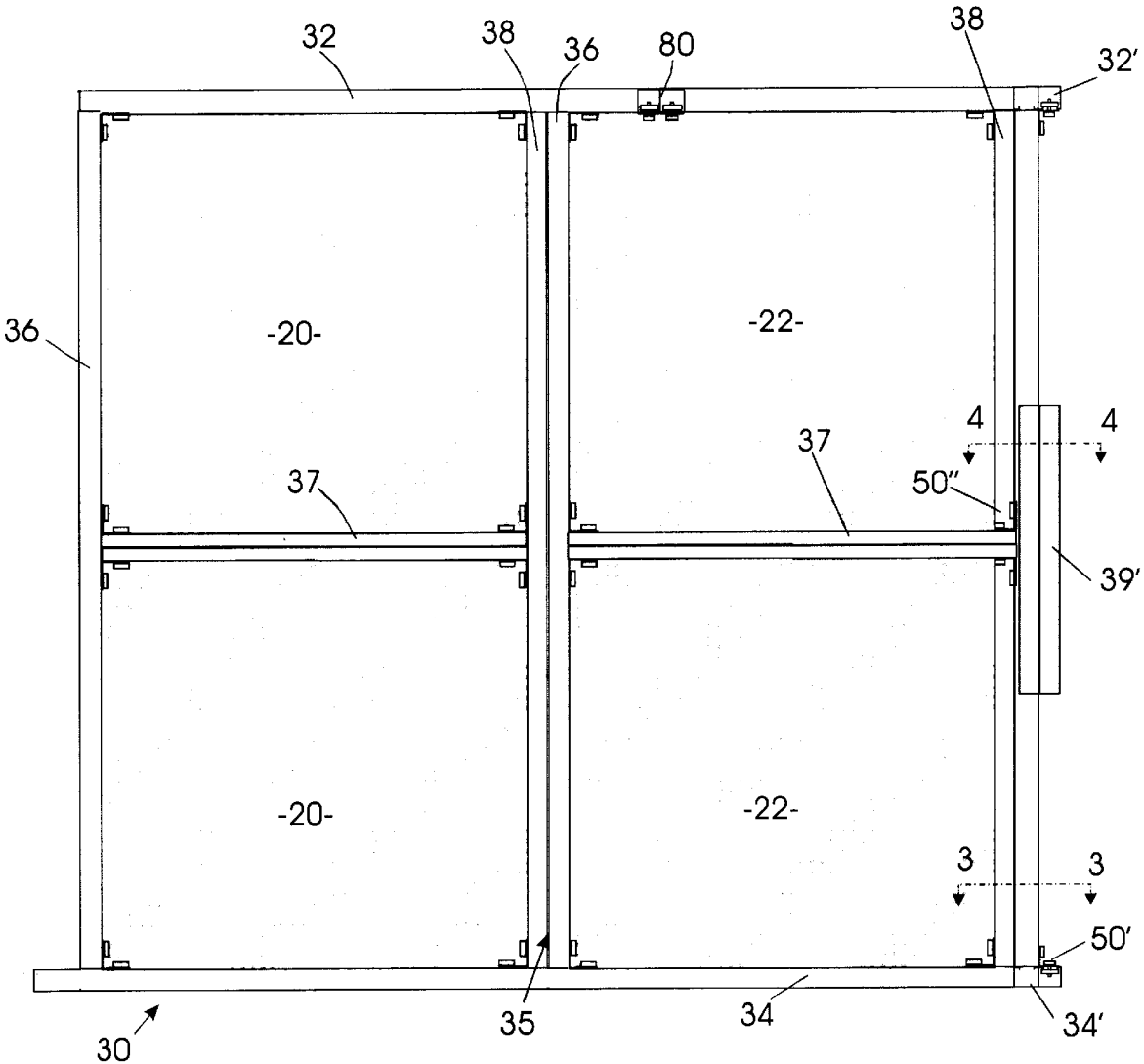
FIG. 1 shows a rear view of a modular shield according to this invention.

In accordance with this invention, FIG. 1 shows a view from outside a containment area of pair of shield modules 10 which includes a pair 20, 22 of sheets of impact-resistant material such as polycarbonate that are held by a frame formed of commercially available open-channel metal frame 30 having a U-shaped cross-section. In the preferred embodiment of the invention, metal frame 30 is Unistrute® metal framing, a product of Unistrut International Corp. Wayne Michigan. Each sheet 20, 22 has a thickness and a plurality of straight sides that are surrounded by top and bottom horizontal members 32, 34, and vertical members 36, 38.

Figure 2:
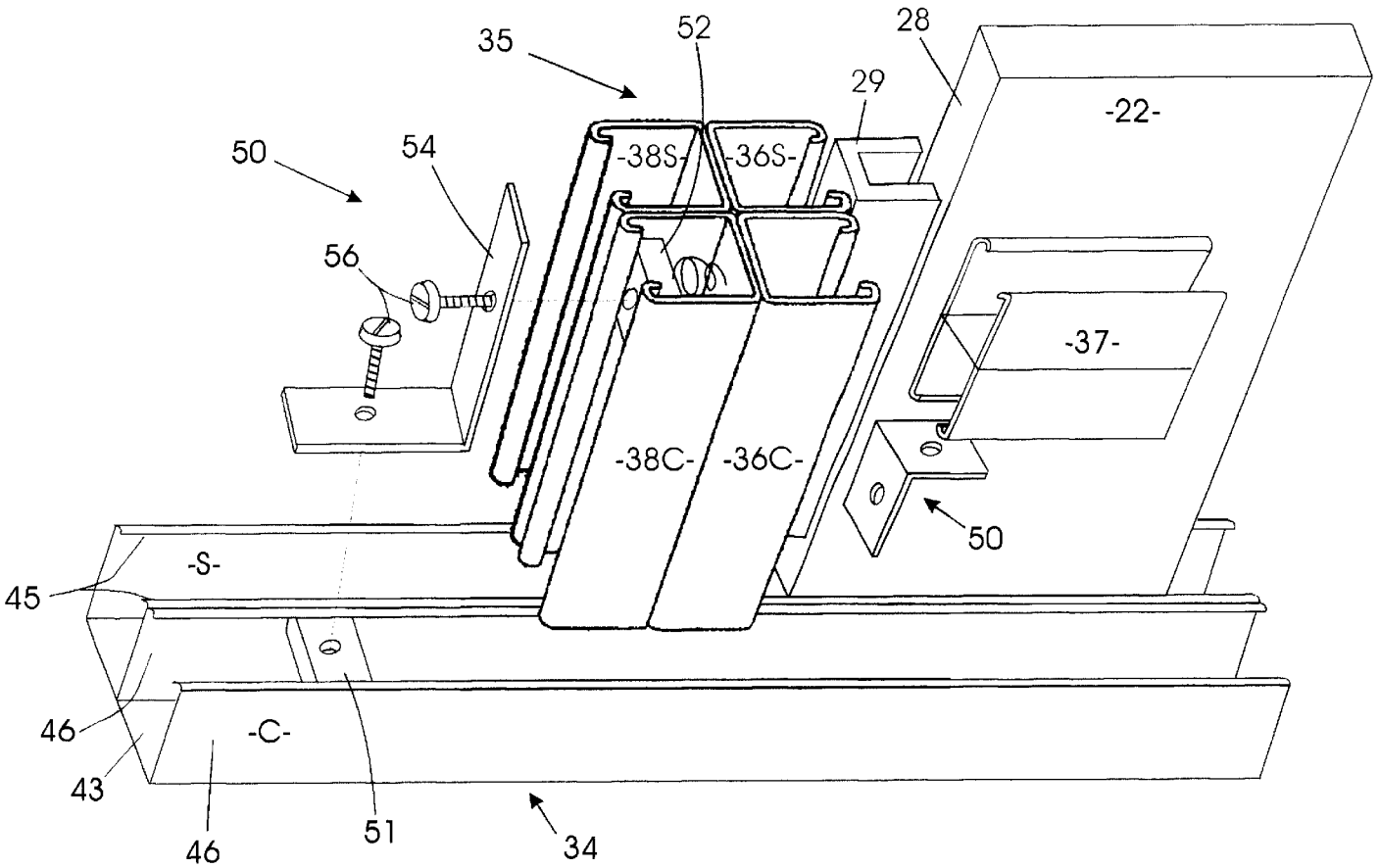
FIGS. 2, 3, and 4 show detail views of sections of the module of FIG. 1.
Figure 4:
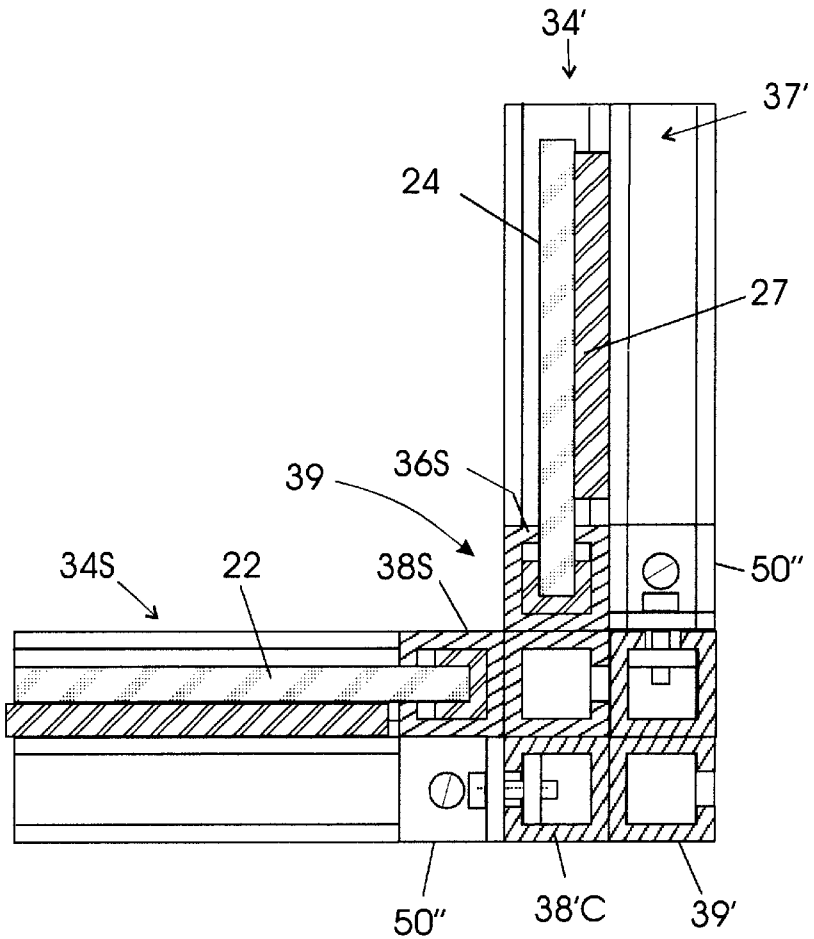

FIG. 2 shows a detail of the construction of a typical portion of module 10. Each member of frame 30 includes two adjacent U-shaped channels S (for holding the shield) and C (for holding clamping hardware), preferably with the open portions of the U facing in the same direction. Each channel includes a bottom portion 43 and spaced, parallel side portions 46 extending from bottom portion 43. The edge 45 of each side portion 46 furthest from bottom portion 43 preferably turns inwardly and faces bottom portion 43, the distance between opposed edges being less than the distance between the sides at bottom portion 43. The shield and clamp channels are typically manufactured as a single unit in contact with each other. For the test embodiment, each channel is 12 gauge steel and has a square 1⅝ inch cross-section and a distance of ¾ inch between edges 45. Other manufacturers make similar frame members.

Adjacent horizontal and vertical frame members may be fastened together with an angle unit 50 that rigidly connects the C channel of each frame member to the C channel of each adjacent frame member. As shown in Unistrut's U.S. Pat. No. 4,784,552, a rectangular nut 51 may be placed within a channel C and biased against edges 45 by a spring 52. The short dimension of nut 51 is less than the distance across the opening between opposing edges 45, while the long dimension is greater than that distance and less than the distance between opposing sides 46. This construction permits a nut 51 to be placed between edges 45, depressed against spring 52, and twisted 90° such that the ends along the long dimension rest against edges 45. This construction enables nut 51 to be placed anywhere along channel C, providing great flexibility in assembling frame members.

When the vertical edges of two shields in the same plane abut, as shown in FIG. 1, the vertical member 38 for sheet 20 is in contact with the oppositely facing vertical member 36 for sheet 22. As shown in FIG. 2, member 35 is manufactured with two channels facing each direction, back-to-back. A portion of sheet 22 is shown in channels 46S and 36S; sheet 20 is not shown in FIG. 2. An angle unit 50 is shown to include a nut 51 in channel 34C and a nut 52 in channel 38C. An angle bracket 54 that has a width greater than the minimum distance between edges 44 fastens member 35 to member 34 with bolts 56 extending into nuts 51, 52 through angle bracket 54. As shown in FIG. 1, similar angle brackets are used at every 90° intersection of adjacent members.

For one embodiment of the invention, sheets 20, 22 were 4'×8' sheets of 0.5' thick Lexan coated with a mar-resistant coating. To prevent sheets 20, 22 from flexing so much under the impact of a projectile that the sheets would pop out of their frame (and, consequently, fall outwardly of the containment area), a brace 37 is provided across the middle of sheets 20, 22. Brace 37 is formed of two channels with adjacent bottom portions. An angle unit 50 is provided at each end of each channel, as shown in FIGS. 1 and 2. Each edge 28 of each sheet is enclosed in a flexible gasket material 29 and placed between the side walls of a channel C. In addition, similar gasket material 27 is placed in the spaced between each sheet and brace 37. Neoprene gasket material is recommended for use with polycarbonate sheeting, and it is available with pressure sensitive tape for ease of assembly.

Figure 3:
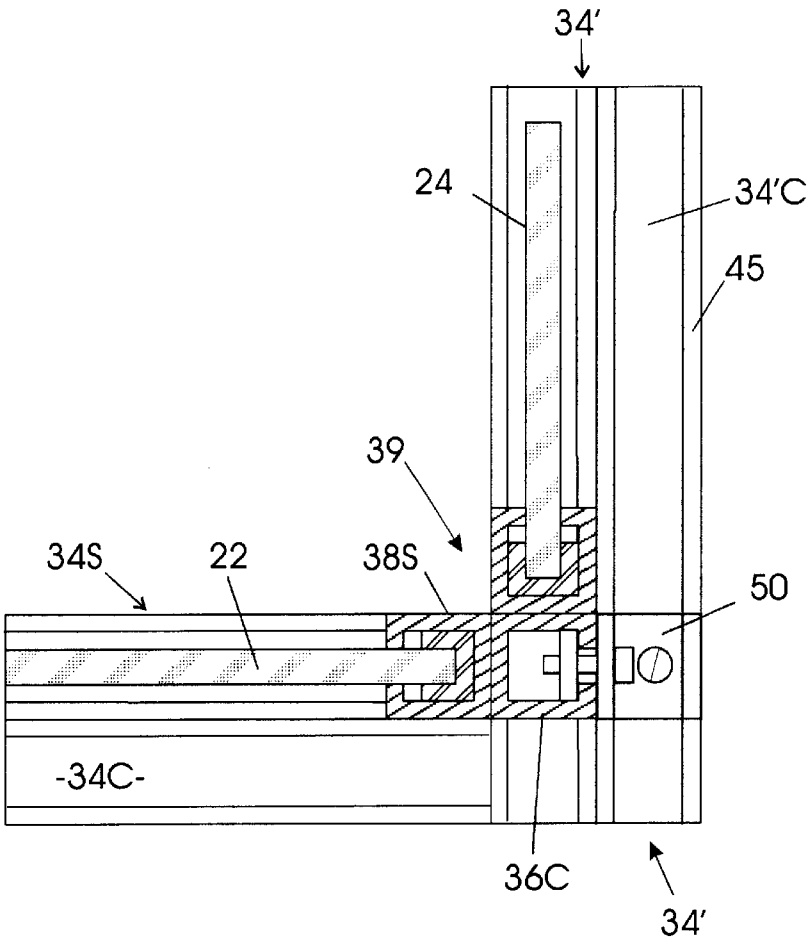

FIG. 3 shows a top view of the connection of the bottom members at the right edge of FIG. 1, where a sheet 24 extends at right angles (into the page) from the edge of sheet 22. Top and bottom members 32, 34 butt into the edge of members 32', 34,' which extend into the page. Member 38 for sheet 22 is part of an integral three channel unit 39: members 38S and 36C are back-to-back, and member 36S extends at a right angle from a side of member 36C. Member 38S is above the end of channel 34S; members 36 and 38' are above channel 34S. An angle unit 50' fastens member 36C to channel 34'C. (Details such as the rolled side walls at the channel openings and the nut of angle unit 50 have been omitted from this and the following figure. These construction details should be understood from FIG. 2.)

In order to support brace 37 at a corner, a short piece of three channel member 39', identical with member 39, is placed around channel 36C at the vertical mid-point of member 39. Angle units 50" fasten the ends of braces 37 and 37', respectively, to channels 38'C and 36'C of member 39', which braces also serve to hold member 39' in place. Although channel 38'C is not rigidly attached to companion channel 38S, as is the case as previously discussed for members 34 and 35, the connections to braces 37 and 37' hold channel 38'C rigidly against channel 38S, and channel 36'C rigidly against channel 36C. A layer of gasket material 27 is also placed between each sheet (such as 22) and its respective brace (such as 37) to cushion the impact of sheet against brace in the event of impact.

Figure 5:
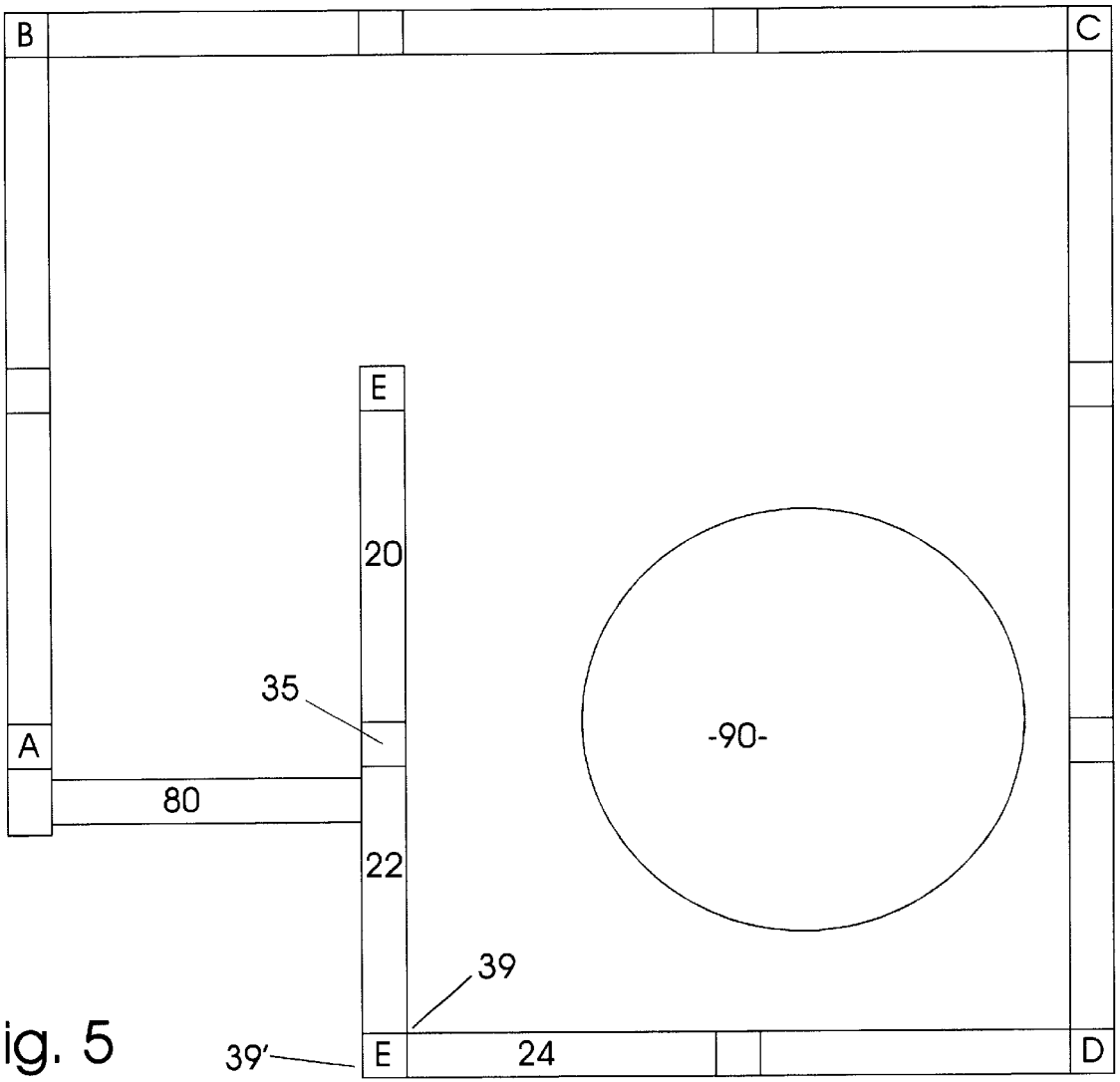
FIG. 5 shows a typical setup of the invention.

FIG. 5 shows a top view of a typical installation of a plurality of modules surrounding a centrifuge 90. The four foot wide by eight foot high modules are connected together to form a continuous, self-supporting, rectangular spiral. Starting at end A, a first modular unit of at least one module extends in a straight line to B, at which point a second modular unit of three modules extends to C at 90° from the line AB. A third modular unit of three modules extends along line CD at 90° to line BC; a fourth modular unit of two modules extends along line DE at 90° to E; and a fifth modular unit of at least one module extends at 90° to line CB and parallel to line FE. A frame member 80 extends from the top frame member 32C at A to the top frame member 32C along EF (FIG. 1) to provide additional lateral support. Because the entrance to the confinement area (the opening from A to line EF) is shielded by wall EF from centrifuge 90, there is no direct projectile escape path from the doorless enclosure.

As shown in FIG. 1, when two or more modules are constructed as a modular unit along a straight line, the top and bottom members 32, 34 are single pieces that extend along the two or more modules. These modules are constructed from the bottom up: the bottom member 34 is put in place, the vertical members 36, 38 and each sheet 20, 22, are fastened in place from one end of bottom member 34, and the top member is fastened in place to lock the modules together.

The arrangement of FIG. 5 was constructed and installed in four days for a total cost of about $30,000. It may be bolted to the floor or, alternatively, left freestanding, as each 4'×8' modular section weighs about 150 lbs. This construction is much quicker and less expensive than equivalent prior art containment facilities where a pit or other significant reconstruction of a building is required.

Because of the lack of impact data in the lower velocity regime (50–500 ft/s), impact proof testing of polycarbonate sheets was performed to determine it's ability to stop the maximum energetic fragment from a Genisco 1082 centrifuge, which has a weight capacity of 80 lb, with a top speed of 700 rpm. The radius of gyration is given as 23 inches. The maximum load for this centrifuge is on the order of 30 pounds. The rotating test mount is surrounded by a temperature chamber, which acts as the primary containment. This chamber is a 4 inch thick composite wall consisting of an interior of 16 gauge stainless steel and an exterior of ¼ inch hot rolled steel, with the space between filled with urethane foam insulation. The temperature chamber is secured to the base, with four, ½ inch diameter, bolts, which is then secured to the floor with another four, ½inch, bolts.

Tests were performed using an air gun to shoot a 30 pound projectile against various parts of the invention at a speed of about 80 ft/sec. This weight and speed corresponds to the maximum projectile and velocity that is predicted to be able to escape the initial confinement of the Genisco 1082 centrifuge.

Initial tests indicated that a system where the polycarbonate sheet was rigidly bolted to the frame was not desirable, as the polycarbonate sheet cracked at the bolt interface, raising the possibility that fragments of the sheet could be propelled outside the containment area. Subsequent tests with a U-channel frame as disclosed herein showed that the combination of a rigid metal frame that is bolted together that surrounds a polycarbonate sheet gave excellent resistance to these projectiles. Hits in the middle of a sheet caused it to bulge against the frame, but outward movement of the frame and sheet was less than 6 inches. No pieces ever broke off the back of the frame or through the sheet. Furthermore, since each hit on a module resulted in every bolt on the module becoming loose, it is apparent that there is significant transfer of energy from the sheet to the frame upon impact, and that the loosening of the frame helps dissipate that energy harmlessly. Thus a bolted system according to the invention has the advantages of being easier to construct, and possibly safer in use, than would be a similar welded system.

The tests showed that a single brace 37 across the middle of a 4'×8' polycarbonate sheet was sufficient bracing for the test impact. Further testing involving the same 30 pound projectile at higher impact speed showed that four spaced braces were needed. This result is not unexpected due to the increase in energy of the projectile as a function of the square of its velocity. The use of metal framing with spring loaded nuts as described herein enables additional braces to easily be added and positioned.

The particular sizes and equipment discussed above are cited merely to illustrate a particular embodiment of this invention. It is contemplated that the use of the invention may involve components having different sizes and shapes as long as the principle, encasing a sheet of material such as polycarbonate in one side of a double tracked U-shaped frame, and fastening a plurality of frames together with the other side of the frame, to form an enclosure for the object being contained, is followed. For example, the sheet could be a layered product. Furthermore, other U-shaped channels could be used in place of Unistrut metal framing. For example, Flex-Strut of Warren, Ohio, offers a similar product that includes turned-over edges and spring loaded nuts. In addition, the thickness of the sheet, the strength of the channels, and the number of braces provided for each application is a matter of test and design.

What is claimed is:

1. A modular system for containing projectiles comprising:

a sheet of material including at least a polycarbonate layer, said sheet having a thickness and a perimeter consisting of a plurality of straight edges;

a metal frame having a straight frame member corresponding to each straight edge of said sheet, each frame member comprising a U-shaped shield channel covering and holding said straight edge and an adjacent U-shaped clamp channel rigidly held against said shield channel, each of said channels having a pair of spaced, parallel side portions connected by a bottom portion, the side portions for said shield and clamp channels extending in the same direction; and a flexible gasket separating each sheet edge from its respective shield channel; and each frame member being fastened to each adjacent frame member only by clamping means extending between adjacent clamp channels.

2. The modular system of claim 1 wherein said sheet is rectangular.

3. The modular system of claim 2 further comprising a bracing frame member extending from the clamp channel of a metal frame member along one edge of said sheet to the clamp channel of a metal frame member along an opposing edge of said sheet.

4. The modular system of claim 3 wherein said bracing frame member consists of a pair of adjacent, straight, U-shaped channels having parallel bottom portions rigidly affixed to each other along their length, and spaced, parallel side portions of one channel extending in an opposite direction from spaced, parallel side portions of the other channel.

5. The modular system of claim 2 wherein said metal is steel and said side portions of said clamping channel have longitudinal edges spaced from said bottom which turn inwardly towards each other, whereby the distance between said edges is less than the distance between said sides at said bottom.

6. The modular system of claim 5 wherein said clamping means comprises:

an angle bracket consisting of a single flat piece of steel having a pair of spaced holes extending through said piece of steel and 90° bend in said piece of steel between said holes;

a pair of nuts having a width greater than the distance between said edges of said sides of said clamping channel; and a pair of bolts, one bolt extending through each hole of said angle bracket, wherein said angle bracket is placed against the edges of two intersecting clamping channels, and a bolt extends through each hole to a nut placed under the edges of each channel.

7. The modular system of claim 2 wherein a modular unit comprises:

a bottom member having said U-shaped channels facing upwardly and rigidly affixed to each other;

at least two adjacent sheets of polycarbonate material having a bottom edge in said shield channel of said bottom member; and a vertical member separating said sheets and having one pair of U-shaped channels facing one of said sheets and a second pair of U-shaped channels facing the other of said sheets, said pairs of U-shaped channels each having a bottom portion, said bottom portions being rigidly affixed to each other.

8. The modular system of claim 7 further comprising a second modular unit extending at 90° to said first modular unit, one end of the bottom member of said first unit abutting a side of the bottom member of said second unit, wherein the vertical frame members at the connection of said modular units comprise:

a three channel unitary member having:

a first shield channel extending above the shield channel of said bottom member of said first unit, an edge of a sheet for said first modular unit being held by said first shield channel;

a clamp channel aligned bottom-to-bottom with said first shield channel and extending above the shield channel of said bottom member of said second unit; and a second shield channel having a bottom affixed to a side portion of said clamp channel and extending above the shield channel of said bottom member of said second unit, an edge of a sheet for said second modular unit being held by said second shield channel.

9. The modular system of claim 8 further comprising:

a second three channel unitary member having a first clamp channel having a side portion in contact with a side portion of said clamp channel of said first three channel unitary member a center channel aligned bottom-to-bottom with said first clamp channel; and a second clamp channel having a bottom affixed to a side portion of said center channel and a side portion in contact with the edge portions of said clamp channel of said first three channel unitary member;

a bracing frame member extending from each of said first and second clamp channels to clamp channels of metal frame members at opposing edges of the sheets extending from said first and second shield channels.

10. The modular system of claim 9 wherein each bracing frame member consists of a pair of adjacent, straight, U-shaped channels having parallel bottom portions rigidly affixed to each other along their length, and spaced, parallel side portions of one channel extending in an opposite direction from spaced, parallel side portions of the other channel.

11. The modular system of claim 10 further comprising a flexible gasket between each said bracing frame member and the adjacent sheet.

12. The modular system of claim 8 further comprising five modular units connected together along a rectangular spiral path, the first unit being parallel to and shorter than the third unit, and the second unit being shorter than and parallel to the fourth unit.

* * * * *